US007011005B2

(12) United States Patent
Koutonen et al.

(10) Patent No.: US 7,011,005 B2
(45) Date of Patent: Mar. 14, 2006

(54) METHOD FOR POSITIONING THE SLITTERS OF A SLITTER-WINDER IN A PAPER OR BOARD MACHINE

(75) Inventors: Pauli Koutonen, Jokela (FI); Jari Paanasalo, Järvenpää (FI)

(73) Assignee: Metso Paper, Inc., Helsinki (FI)

( * ) Notice: Subject to any disclaimer, the term of this patent is extended or adjusted under 35 U.S.C. 154(b) by 242 days.

(21) Appl. No.: 10/477,484

(22) PCT Filed: May 13, 2002

(86) PCT No.: PCT/FI02/00405

§ 371 (c)(1),
(2), (4) Date: Nov. 12, 2003

(87) PCT Pub. No.: WO02/092294

PCT Pub. Date: Nov. 21, 2002

(65) Prior Publication Data

US 2004/0144223 A1 Jul. 29, 2004

(30) Foreign Application Priority Data

May 14, 2001 (FI) ..... 20011005

(51) Int. Cl.
*B26D 1/00* (2006.01)
*B27B 5/34* (2006.01)

(52) U.S. Cl. ..... 83/34; 83/425.4; 83/508.3

(58) Field of Classification Search ..... 83/34, 83/425.4, 508.3
See application file for complete search history.

(56) References Cited

U.S. PATENT DOCUMENTS 3,257,882 A 6/1966 Lulie et al.
3,408,886 A 11/1968 David
3,587,374 A 6/1971 Stewart
3,651,723 A 3/1972 Gallagher, Jr. et al.
3,961,547 A 6/1976 Shainberg et al.
4,398,678 A 8/1983 Kron et al.
4,484,500 A 11/1984 Reba et al.
4,516,454 A 5/1985 Mosburger
4,548,105 A 10/1985 Koutonen
4,629,139 A 12/1986 Sanda et al.
4,697,755 A 10/1987 Kataoka
4,746,076 A 5/1988 Tomma et al.
4,798,110 A * 1/1989 Tokuno et al. ..... 83/13
4,846,416 A 7/1989 Natale (Continued)

FOREIGN PATENT DOCUMENTS

DE 42 24 010 A1 2/1993

(Continued)

OTHER PUBLICATIONS

Search Report issued in Finnish App. No. 20011005.

(Continued)

*Primary Examiner*—Allan N. Shoap
*Assistant Examiner*—Isaac N Hamilton
(74) *Attorney, Agent, or Firm*—Stiennon & Stiennon

(57) ABSTRACT

The slitters of a slitter-winder in a paper or board machine are placed in position in slitting to slit component webs to the desired width. The slitters are moved to a new slitting position as a normal movement when the slitter-winder has stopped after slitting according to the preceding slitter setting. In positioning the slitters, at least one slitter not in use in the slitter-winder is moved before the normal movement as an advance movement to a new slitting position and/or to a waiting position for the next slitting position while the other slitters are slitting the web.

12 Claims, 4 Drawing Sheets

U.S. PATENT DOCUMENTS

| | | | | |
|---|---|---|---|---|
| 5,217,177 | A | 6/1993 | Stefanoni | |
| 5,251,835 | A | 10/1993 | Kyytsönen | |
| 5,363,730 | A | 11/1994 | Besemann | |
| 5,620,151 | A | 4/1997 | Ueyama et al. | |
| 5,954,291 | A | 9/1999 | Meinecke et al. | |
| 6,092,452 | A * | 7/2000 | Adami | 83/428 |
| 6,286,404 | B1 | 9/2001 | Miglietta | |
| 2002/0017586 | A1 | 2/2002 | Koutonen | |
| 2003/0192413 | A1 * | 10/2003 | Aoki | 83/13 |

FOREIGN PATENT DOCUMENTS

| | | | |
|---|---|---|---|
| EP | 0 380 438 | A1 | 8/1990 |
| EP | 0 685 304 | A1 | 12/1995 |
| EP | 0 894 583 | A2 | 2/1999 |
| FI | 68185 | | 4/1985 |
| FI | 74260 | B | 9/1987 |
| FI | 091383 | B | 3/1994 |
| WO | WO 96/37429 | A1 | 11/1996 |
| WO | WO 97/35696 | A1 | 10/1997 |
| WO | WO 02/092294 | A3 | 11/2002 |

OTHER PUBLICATIONS

International Preliminary Examination Report issued in PCT/FI02/00405.

International Search Report issued in PCT/FI02/00405.

* cited by examiner

METHOD FOR POSITIONING THE SLITTERS OF A SLITTER-WINDER IN A PAPER OR BOARD MACHINE

CROSS REFERENCES TO RELATED APPLICATIONS

This application is a U.S. national stage application of International Application No. PCT/FI02/0045, and claims priority on Finnish Application No. 20011005, filed May 14, 2001.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The invention relates to a method for positioning the slitters of a slitter-winder in a paper or board machine, in which method the slitters of the slitter-winder are placed in position in slitting to slit component webs to the desired width, in which method the slitters are moved to a new slitting position as a normal movement when the slitter-winder has stopped after slitting according to the preceding slitter setting.

With respect to the prior art, reference is made to FI patent 68 185, which describes a method for determining the position of a movable device or a member of this device and/or for determining a corrective movement to be performed from this position by means of a movable measuring device that observes and records the position. This publication describes the use of the method, for example, in a system used in longitudinal slitting of a paper web, in which system the movable device is a slitting device and the measuring device is in a position arrangement which comprises actuating members for controlling and performing the movement of the measuring device in the cross direction of the web.

As known in the prior art, the slitter-winder comprises slitters which are placed side by side in the cross direction of the web and by which the web is cut into several component webs. The width of component webs and, thus, the position of a slitter or slitters can be very different on different slitter settings depending on the desired widths of the rolls to be produced. The slitters must be placed, in a manner corresponding to the desired roll widths, in a correct slitting position in the width direction of the web.

In the slitter-winder, the movements of the slitters are made, as known in the prior art, when the last set of the preceding slitter setting has been discharged and the slitter-winder has stopped. In the arrangements known in the prior art, the time of movement of the slitters is one minute on average. In one application known in the prior art, the apparatus moving the slitters comprises only one actuator for movement, which is common to all slitters. The actuator is an electric servomotor which moves the slitters by means of a ball screw and transfer rods. By this means, the transfer motors provided for each individual slitter known in prior art applications have been avoided. The stroke length of the transfer rods is about 1 m and, when the stroke has reached the end limit, the direction of movement must be changed. All the same slitters moving in the same direction must move at the same pace, slitters are being moved only in one direction at a time. Sometimes it is necessary to move mere transfer rods backwards without slitters if their remaining stroke is not sufficient for the movement distances of all slitters.

As known in the prior art, in the settings of the slitter-winder the number of rolls to be produced is generally smaller than the maximum number of rolls, which means that one or more slitters are not in use, i.e. they do not cut the web. In most cases, however, these slitters cannot remain unmoved, because otherwise they might obstruct the movement of the slitters which will be used.

As known in the prior art, the slitter movement sequence performs several strokes of transfer rods in both directions until all slitters are in position, and the movements are continued in the same direction as long as there remain any slitters to be moved or until transfer rods are at the end limit. In that case, the direction must be changed and the sequence is continued. It may be necessary to continue with these partial movement sequences in both directions several times if the stroke length of the transfer rods is not sufficient to position the slitters which must be moved the very longest distance. Every time the transfer rods move, all the slitters to be moved in the same direction participate in the movement and the slitter making the shortest movement is left in position first. Thus, the total movement time is not merely the time of movement of the slitter to be moved the longest distance at a constant speed because this slitter must stop when each of the other slitters is placed in position.

SUMMARY OF THE INVENTION

An object of the invention is to provide a method for positioning the slitters of a slitter-winder in a paper or board machine by which the movement time of the slitters is significantly shortened even to a few seconds.

With a view to achieving the objects described above as well as the ones that will come out later, the method according to the invention is mainly characterized in that, in the method, in positioning of the slitters, at least one slitter not in use in the slitter-winder is moved before the normal movement as an advance movement to a new slitting position and/or to a waiting position for the next slitting position while the other slitters are slitting the web.

In accordance with the invention, in positioning of the slitters of a slitter winder, at least one slitter which is not in use is moved to a new slitting position and/or to a waiting position for the next slitting position while the other slitters are cutting the web. The waiting position is an advance movement position from which the slitter can be moved during the actual movement to a new slitting position in connection with other movements such that it most preferably does not cause further stops but can be placed in position simultaneously with another/other slitters. The waiting position can be from a slitter position before an advance movement towards a new slitting position or backwards. The slitters selected for an advance movement are most appropriately moved to a new slitting position or to a waiting position, for example, to the middle area of the movement area to a correct location such that, when stopping at a desired slitting position in connection with the next movement, during one stop of the transfer device of the slitters it is possible to place several slitters in a correct new slitting position. In addition, an object of the invention is to provide a method in which the movement distance is as short as possible.

By an advance movement is meant a movement of slitters in which the slitters which have been selected for a movement to be made in advance and which are not in use are moved while the slitters which are in use are still slitting the web.

By a normal movement is meant a movement of slitters in which the slitters which will be needed are moved to the next slitting position while the slitter-winder is stopped.

By a unit movement is meant one stroke of a transfer rod by which one or more slitters are moved.

In accordance with the invention, by means of advance movement, a method is provided which enables the time needed for positioning the slitters in a slitter-winder to be minimized. To minimize the movement time, the number of movements is kept to the minimum and those movements are made in advance which can be made while operating according to the preceding slitter setting. Those slitters which are included in the preceding slitter setting, can, of course, not be moved during the advance movement, but, instead, they are moved, when needed, in connection with the actual movement.

An object of the invention is to minimize the slitter movement time and it is achieved by means of advance movement in which, while still operating according to the preceding slitter setting, all those movements are completed which can be made without disturbing the running operation. In the prior art, all movements are made only after the last set of the preceding slitter setting has been discharged and the slitter-winder has stopped. The slitter movement time in arrangements according to the prior art is one minute on average. When accomplished by the method according to the invention, the slitter movement time is 10 s on average in tests, which means that the saving of time attainable by the invention is very significant.

In the method according to the invention, advance movement of slitters in a slitter-winder is made, for example, during the last set of the preceding slitter setting or, when desired, even earlier, however, during the time when the slitters which are in use are still cutting the web. The advance movement is similar to the normal movement in basic principles, but certain special situations have been taken separately into account in the method in accordance with the invention.

The slitters which are being used cannot be moved from their position, so an advance movement is made only in the case of those slitters which do not cut the web and which have been selected for an advance movement based on a selection algorithm.

A slitter which is in use may prevent the movement of some slitter according to a new slitter setting all the way to the end, in which case that slitter is moved in an advance movement to another suitable waiting position.

The slitters which are not used for the preceding slitter setting and which cannot be moved to their intended positions are attempted to be moved to such waiting positions that the number of movement distances of different lengths is minimized.

At the end of the sequence, the transfer rods are driven to such a position that no empty movement need be made in the final movement when the stroke of the transfer rods is not sufficient.

A measurement for verifying the location of the slitters is made before advance movement if the locations of the slitters are not known. After the advance movement, a verifying measurement is made to check the locations of the slitters. If needed, the measurement-movement-measurement sequence is repeated to correct the errors so that they shall be within tolerances. Thus, the advance movement also has the advantage that the final movement can be started without a preliminary verifying measurement.

The movement distances of slitters are checked with respect to the locations of the slitters which remain stationary; if there is a collision, the target location is computed again. Here, action is according to the minimization of movements. When computing common movement distances, the slitters which now remain stationary and other slitters which cannot be immediately moved to the target must be taken into consideration.

In the following, the invention will be described in greater detail with reference to the figures in the accompanying drawing, but the invention is by no means meant to be narrowly confined to the details of the figures.

DESCRIPTION OF THE PREFERRED EMBODIMENTS

Figure 1:
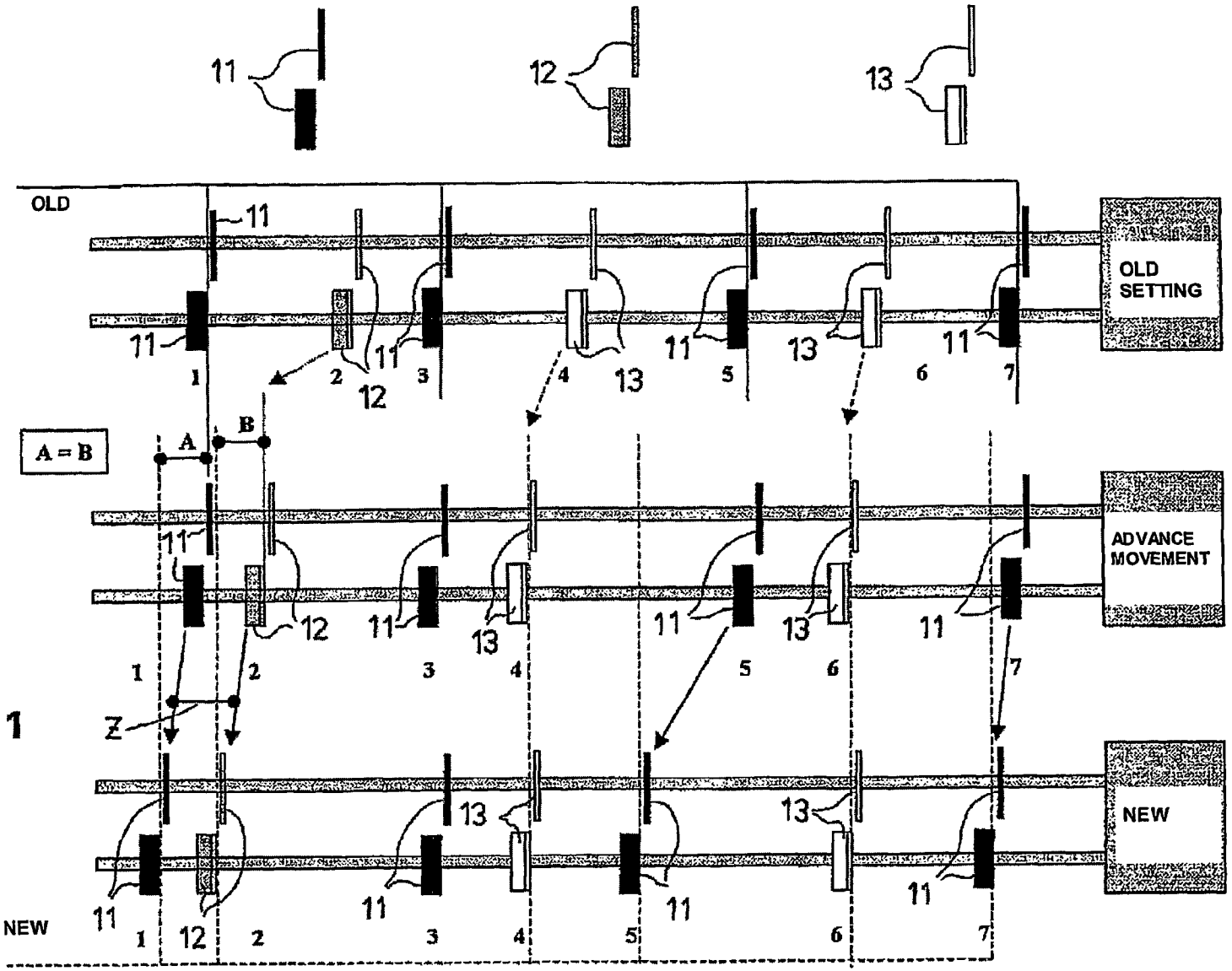
FIG. 1 schematically shows changing of the position of slitters in a slitter-winder in accordance with one application of the invention.

FIG. 1 shows a case in which a machine comprises seven slitters. The slitters according to an old setting are denoted with the reference numeral 11 and with a black colour, the slitters moved to a waiting position in an advance movement are denoted with the numeral 12 and with a grey colour, and the slitters moved to a new slitting position in an advance movement are denoted with the reference numeral 13 and with a white colour. In the preceding setting (OLD SETTING) there are four cuts (three rolls), in which connection three slitters are not in use. A new setting comprises six cuts, in which connection only one slitter remains unused. The slitters 1, 5, 7 are in use in the preceding (OLD) setting and in the new setting, the slitter 3 is in use only in the preceding (OLD) setting. The slitters 4 and 6 can be moved to their positions already in an advance movement, the slitter 2 must be moved to a waiting position, in which its movement distance will be the same as that of the slitter 1. In the final or actual movement sequence, three unit movements must be made in a –direction to move the slitters 1, 2, 5, and 7 to their final positions. As shown in the figure, the movement distance is equal for the slitters 1 and 2, i.e. A=B. The slitter 3 can remain unmoved altogether because it does not obstruct other movements. Without the advance movement in accordance with the invention it would have been necessary to make six unit movements for all slitters except the slitter 3. If it had been necessary to move the slitter 3, too, the total number of unit movements would have been seven. At the point Z, a simultaneous synchronous movement is made.

Figure 2A:
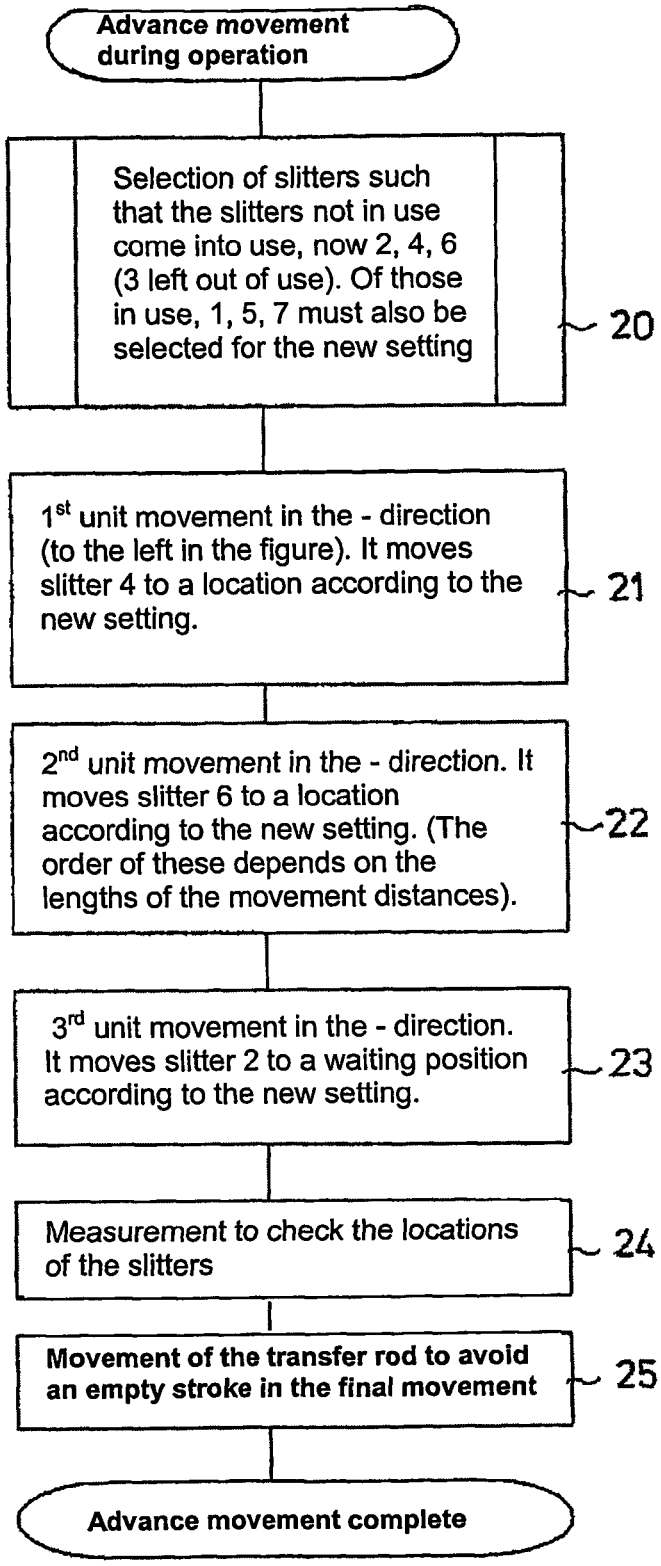
FIGS. 2A and 2B show a schematic block diagram of the method in accordance with the invention.
Figure 2B:
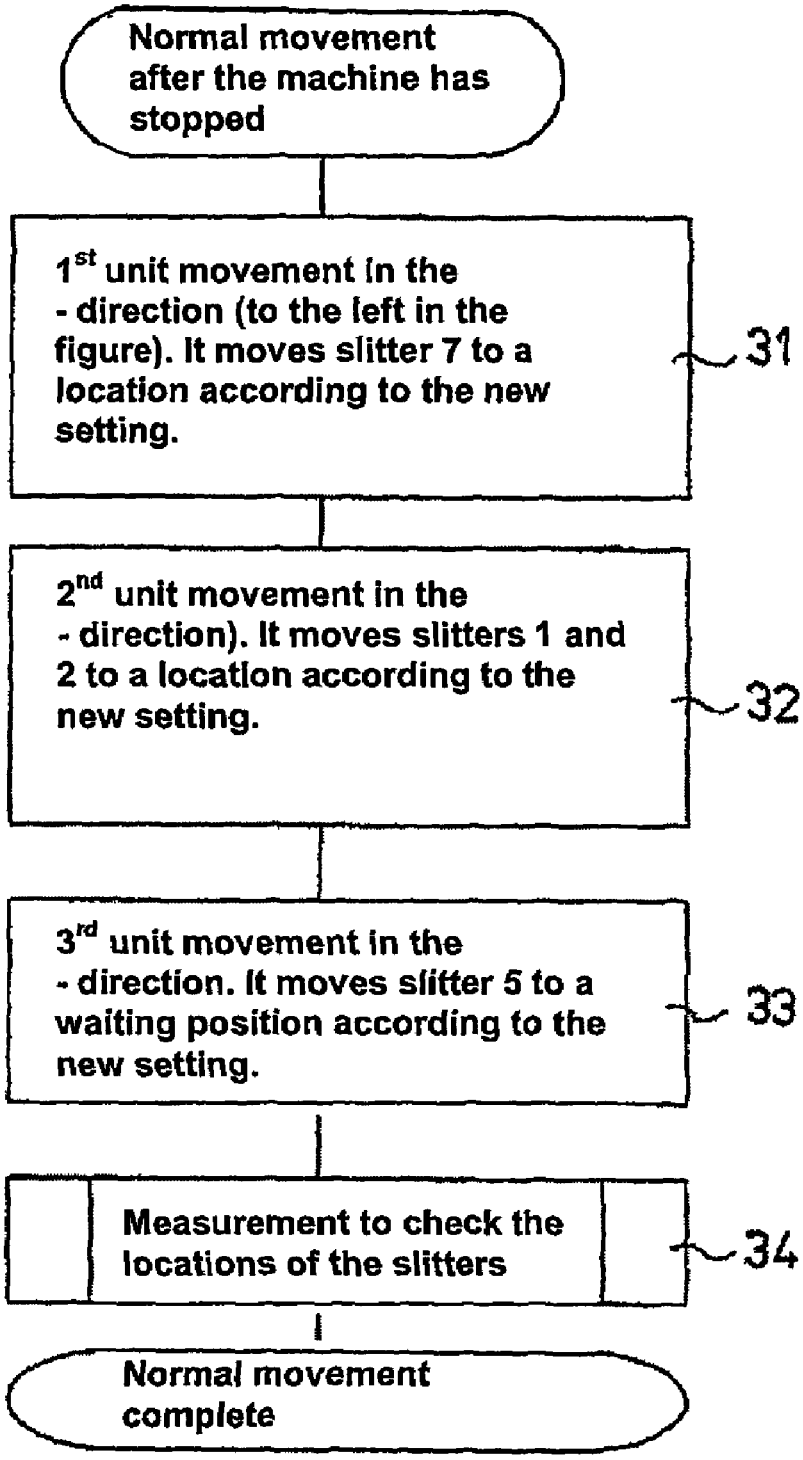

As shown in the schematic block diagram of FIGS. 2A and 2B, the advance movements (FIG. 2A) during operation are accomplished as shown in the block diagram in the cases according to FIG. 1. At first, a selection of slitters is made such that the slitters not being used come into use, now the slitters 2, 4, 6 (3 is left out of use). Of the slitters in use, 1, 5, 7 must also be selected for the new setting. After the selection 20 of the slitters, in the first stage 21, a first unit movement is made in a direction to the left in FIG. 1. This moves the slitter 4 to a slitting position according to the new setting. Next, in the second stage 22, a second unit movement is made in the minus direction, which moves the slitter 6 in FIG. 1 to a slitting position according to the new setting. The order of these movements depends on the length of the movement distances. In the third stage 23, a third unit movement is made in the minus direction, in which connection the slitter 2 is moved to a waiting position according to the new setting. In the fourth stage 24, a measurement is made to check the locations of the slitters and, in the fifth stage 25, a transfer rod (transfer device) is moved in order to avoid an empty stroke in the final or normal movement. During the final or normal movement (FIG. 2B), when the machine has stopped, in the first stage 31, a first unit movement is made first in the minus direction to the left in FIG. 1, in which connection the slitter 7 is moved to a new slitting position according to the new setting. In the second stage 32, in the actual movement, a second unit movement is made in the minus direction, in which connection the slitters 1 and 2 are moved to a slitting position according to the new setting. In the third stage 33, a third unit movement is made in the minus direction, in which connection the slitter 5 is moved to a waiting position according to the new setting. After that, a measurement 34 is made to check the locations of the slitters, after which the normal movement has been completed.

Figure 3:
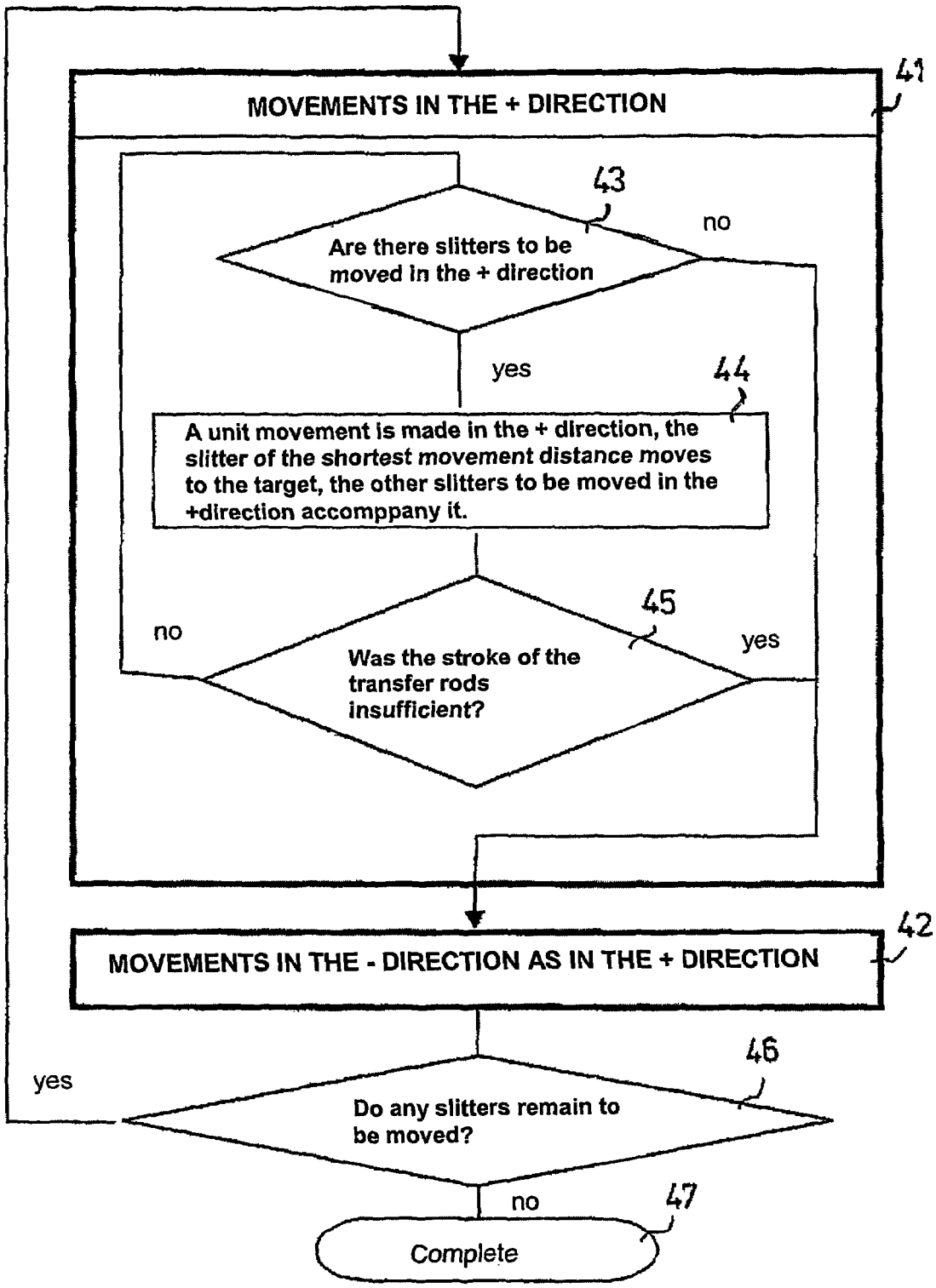
FIG. 3 shows a schematic step diagram of the slitter movement sequence.

In accordance with the schematic slitter movement sequence shown in FIG. 3, either movements in the plus direction or movements in the minus direction 41, 42 are made. First it is ascertained whether there are any slitters to be moved in the plus direction, stage 43. If there are such slitters, a unit movement is made in the plus direction, the slitter of the shortest movement distance moves to the target and the other slitters to be moved in the plus direction accompany it, stage 44. If the stroke of the transfer rods (transfer device) was too short, stage 45, it is checked whether any movements 42 remain to be made in the minus direction. If yes, the movements are made as the movements in the plus direction. It is checked whether there are any slitters to be moved, stage 46, if not, the movements have been completed, stage 47.

As shown in FIG. 3, the slitter movement sequence makes several strokes of the transfer rods in both directions (+direction=location increases, −direction=location decreases) until all slitters are in position. These movement strokes are called unit movements in the following. The movements are continued in the same direction as long as there are slitters left to be moved or until the transfer rods are at the end limit. In that case, the direction must be changed and the sequence is continued in the same way. It may be necessary to continue to carry out these partial movement sequences in both directions several times if the stroke length of the transfer rods is not sufficient to position the slitters to be moved the longest distance. Every time the transfer rods move, all the slitters to be moved in the same direction are included, and the slitter making the shortest movement gets off first. The total movement time is not only the time of movement of the slitter to be moved the longest distance at a constant speed because this slitter must stop at each "intermediary station" where some slitter of a shorter movement gets off. To minimize the movement time, it is thus worth keeping the number of movements to their minimum or making in advance those movements which can be made while the preceding setting is still being run. The slitters included in the preceding setting cannot be included in advance movement.

According to one advantageous application of the method in accordance with the invention, the slitters of advance movement are attempted to be selected according to the slitter setting such that the slitters not in use are distributed evenly across the width of the machine.

Above, the invention has been described with reference to one of its advantageous embodiment examples, to the details of which the invention is, however, not by any means intended to be narrowly confined.

The invention claimed is:

1. A method for positioning slitters of a slitter-winder in a paper or board machine for slitting a web, comprising the steps of:

from a first plurality of slitters, positioning a second plurality of slitters comprising less than all the first plurality of slitters of the slitter-winder, at first selected slitter settings, and slitting the web to form component webs of first desired widths;

in an advance movement, moving at least one slitter of the first plurality of slitters which is not of the second plurality of slitters to a first new slitting position and/or to a waiting position for a future slitting position, while the second plurality of slitters are slitting the web to form component webs;

stopping the slitter-winder;

in a second normal movement, moving at least some of the second plurality of slitters to a new slitting position and moving the at least one slitter of the first plurality of slitters which is not of the second plurality of slitters from the waiting position to a second new slitting position or leaving the at least one slitter of the first plurality of slitters which is not of the second plurality of slitters in the first new slitting position; and slitting the web into component webs of second desired widths with the at least some of the second plurality of slitters and the at least one slitter of the first plurality of slitters which is not of the second plurality of slitters.

2. The method of claim 1, wherein the at least one slitter of the first plurality of slitters which is not of the second plurality of slitters is moved by the advance movement to a first new slitting position or to a waiting position such that, in connection with the second normal movement, when stopping at a desired slitting position during one stop of a transfer device of the slitters, as many slitters as possible are placed in a new slitting position during the same stop.

3. The method of claim 1, wherein, during the advance movement, a slitter of the first plurality of slitters which are not of the second plurality of slitters, which can be moved to a new slitting position, is moved to said new slitting position.

4. The method of claim 1, wherein, during the advance movement, slitters of the first plurality of slitters which are not of the second plurality of slitters which are prevented from being moved all the way to a new slitting position according to a new setting, are moved in the advance movement to waiting positions.

5. The method of claim 4, wherein, in the advance movement, the slitters of the first plurality of slitters which are not of the second plurality of slitters, which cannot be moved to a slitting position during the advance movement are moved to a selected waiting position such that the number of movement distances of different lengths of a transfer device of the slitters is minimized.

6. The method of claim 1 wherein, in the advance movement, the first plurality of slitters which are not of the second plurality of slitters, are distributed substantially evenly across the width of the machine.

7. The method of claim 1 wherein a position of a slitter of the first plurality of slitters is measured before the advance movement if the slitter's position is not known.

8. A method for positioning slitters of a slitter-winder in a paper or board machine for slitting a web, the slitter-winder being of the type having a plurality of slitters arrayed for movement in a cross machine direction, and the slitter-winder having one actuator for causing all cross machine direction motion of each of the slitters of the plurality of slitters, the method comprising the steps of:

slitting a paper web to form component webs to first desired widths, with a first group of slitters of the plurality of slitters, which first group is less than all of the plurality of slitters, thus defining a second group of slitters of the plurality of slitters which is not in use;

prepositioning by an advance movement at least one of the second group of slitters with the one actuator in an advance movement, to a first new slitting position and/or to a waiting position while the first group of slitters are slitting the web into component webs;

stopping the slitter-winder;

in a second normal movement, moving at least one of the first group of slitters with the one actuator to a new slitting position and moving with the one actuator the at least one slitter of the second group of slitters to a second new slitting position or leaving the at least one slitter of the second group of slitters in the first new slitting position;

wherein the first new slitting position and/or the waiting position is selected so that the time to position all of a third group of slitters comprising said at least some of the first group of slitters and the at least one of the second group of slitters is reduced; and slitting the web into component webs of second desired widths with the third group of slitters.

9. The method of claim 8, wherein prepositioning of the at least one of the second group of slitters is done in connection with the second normal move, so that as many slitters as possible are placed in a new slitting position during a single stop of the one actuator.

10. The method of claim 8 wherein, in the advance movement, the second group of slitters are arranged such that the second group of slitters are distributed substantially evenly across the width of the machine.

11. The method of claim 10, wherein, in the advance movement, at least one slitter of the second group of slitters, which cannot be moved to a slitting position during the advance movement, is moved to a selected waiting position such that the number of movement distances of different lengths of the one actuator is minimized.

12. The method of claim 8 wherein a position of a slitter of the plurality of slitters is measured before the advance movement if the slitter's position is not known.

* * * * *